US010443604B2

(12) United States Patent
Harrison et al.

(10) Patent No.: US 10,443,604 B2
(45) Date of Patent: Oct. 15, 2019

(54) SYSTEMS AND METHODS TO CLAMP AN IMPELLER TO A COMPRESSOR SHAFT

(71) Applicant: TRANE INTERNATIONAL INC., Piscataway, NJ (US)

(72) Inventors: Mark W. Harrison, Onalaska, WI (US); Jon Christopher Johnson, New Albin, IA (US); Todd W. Smith, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 463 days.

(21) Appl. No.: 14/929,640

(22) Filed: Nov. 2, 2015

(65) Prior Publication Data

US 2016/0123342 A1 May 5, 2016

Related U.S. Application Data

(60) Provisional application No. 62/073,489, filed on Oct. 31, 2014.

(51) Int. Cl.

| | |
|---|---|
| ***F04D 17/12*** | (2006.01) |
| ***F04D 29/051*** | (2006.01) |
| ***F04D 29/62*** | (2006.01) |
| ***F04D 25/06*** | (2006.01) |
| ***F04D 29/26*** | (2006.01) |

(52) U.S. Cl.

CPC ..... *F04D 29/051* (2013.01); *F04D 17/122* (2013.01); *F04D 25/06* (2013.01); *F04D 29/266* (2013.01); *F04D 29/624* (2013.01); *F05D 2260/31* (2013.01)

(58) Field of Classification Search

CPC .... F04D 29/051; F04D 17/122; F04D 29/284; F04D 29/266; F04D 29/624; F04D 25/06; F05D 2260/31; F01D 5/025

See application file for complete search history.

(56) References Cited

U.S. PATENT DOCUMENTS

| | | | | |
|---|---|---|---|---|
| 3,019,039 | A * | 1/1962 | Clavell | F01D 5/025 403/273 |
| 3,612,719 | A | 10/1971 | Nomura | |
| 3,677,663 | A | 7/1972 | Cronstedt | |
| 3,771,927 | A | 11/1973 | Schiller | |
| 5,163,816 | A | 11/1992 | Goetzke et al. | |

(Continued)

FOREIGN PATENT DOCUMENTS

| | | | |
|---|---|---|---|
| CN | 103620185 | A | 3/2014 |
| CN | 103758789 | A | 4/2014 |

*Primary Examiner* — Jacob J Cigna
*Assistant Examiner* — Lee A Holly
(74) *Attorney, Agent, or Firm* — Hamre, Schumann, Mueller & Larson, P.C.

(57) ABSTRACT

Systems and methods to clamp an impeller on a shaft in a centrifugal compressor. The embodiments as disclosed herein may include clamping individual impeller independently to the shaft, which may reduce the tolerance stack-up effect of a plurality of impellers. The impeller can be clamped to the shaft by positioning, for example, a relatively stiff support (e.g. a shaft locknut) on a front side of the impeller. The impeller can also be clamped to the shaft by a relatively flexible support to compensate for e.g. thermal expansion/contraction of the impeller. The embodiments as disclosed herein are particularly suitable for a multi-stage impeller.

12 Claims, 5 Drawing Sheets

(56) References Cited

U.S. PATENT DOCUMENTS

| | | | | |
|---|---|---|---|---|
| 6,126,357 | A | 10/2000 | Alkelin et al. | |
| 6,290,467 | B1 | 9/2001 | Dewhirst et al. | |
| 6,481,917 | B1 | 11/2002 | Chen et al. | |
| 7,018,177 | B2 | 3/2006 | Feher | |
| 7,182,579 | B2 * | 2/2007 | Roso | F01D 5/025 416/204 A |
| 8,070,426 | B2 | 12/2011 | Brunner et al. | |
| 8,684,696 | B2 | 4/2014 | Ress | |
| 2007/0227516 | A1 | 10/2007 | Middlebrook et al. | |
| 2008/0115527 | A1 * | 5/2008 | Doty | F04D 25/0606 62/498 |
| 2012/0093661 | A1 * | 4/2012 | Vick | F04D 25/04 416/244 R |
| 2014/0125208 | A1 * | 5/2014 | Yamashita | F02C 6/12 310/68 B |
| 2014/0178196 | A1 | 6/2014 | Lucas et al. | |
| 2014/0271162 | A1 | 9/2014 | Karl et al. | |
| 2014/0341710 | A1 * | 11/2014 | Creamer | F04D 29/063 415/111 |
| 2014/0341715 | A1 | 11/2014 | Baehmann et al. | |

* cited by examiner

SYSTEMS AND METHODS TO CLAMP AN IMPELLER TO A COMPRESSOR SHAFT

FIELD

This disclosure relates to a compressor, such as a centrifugal compressor in a heating, ventilation, and air conditioning (HVAC) system. More specifically, the disclosure relates to systems and methods to clamp an impeller to a shaft in a compressor.

BACKGROUND

In a compressor, e.g., a centrifugal compressor, one or more centrifugal impellers may be used to compress a fluid (e.g., gaseous refrigerant). Typically, the one or more impellers are mounted on a shaft, which is driven by a motor. In operation, the one or more impellers may be stressed/deformed by a thrust generated in the compressor. The deformation of the one or more impellers can cause operational vibration/noise.

SUMMARY

Systems and methods to clamp an impeller to a shaft in a compressor, e.g., a multi-stage centrifugal compressor, are disclosed. Generally, each impeller in the compressor may be clamped to the shaft individually by a supporting assembly so that deflection/deformation caused by a thrust load on each impeller can be at least partially relieved by the supporting assembly. Embodiments disclosed in this specification may help reduce, for example, a tolerance stack-up effect of the impellers and their assembly in a multi-stage compressor.

In some embodiments, a supporting assembly to clamp the impeller may include a relatively stiff support to support a front side of the impeller, and a relatively flexible support to support a backside of the impeller. The front side of the impeller is a side that receives a fluid in operation (e.g., an outboard side), and the backside is opposite to the front side with the respect to the impeller (e.g., an inboard side). Thus, the impeller is supported by the oppositely positioned relatively stiff support and the relatively flexible support. In some embodiments, the relatively stiff support may be positioned to relieve at least a portion of the deflection/deformation caused by the thrust load on the impeller during operation.

In some embodiments, the relatively stiff support may include a locknut configured to provide a relatively stiff support to the front side of the impeller, which can help reduce a deflection of the impeller. In some embodiments, the relatively stiff support may further include a spacer (e.g., a washer) between the locknut and the front side of the impeller.

In some embodiments, the relatively flexible support may include a spring member configured to provide a relatively flexible support to the backside of the impeller, which can help compensate for, e.g., thermal expansion/contraction of the impeller and/or reduce deflection to a shaft on which the impeller is mounted. In some embodiments, a shim member may be included and positioned between the backside of the impeller and the spring member. In some embodiments, the spring member may include a conical washer such as, but not limited to, a Belleville washer, or the like. In some embodiments, the relatively flexible support may also include a spacing member.

In some embodiments, the compressor may be a multi-stage compressor including more than one impeller. In some embodiments, the multi-stage compressor can include a two-stage compressor. In some embodiments, the multi-stage compressor can include three or more stages. In some embodiments, the compressor may be a refrigerant compressor in an HVAC system.

Other features and aspects of the systems, methods, and control concepts will become apparent by consideration of the following detailed description and accompanying drawings.

BRIEF DESCRIPTION OF THE DRAWINGS

References are made to the accompanying drawings that form a part of this disclosure, and which illustrate embodiments in which the systems and methods described in this specification can be practiced. Like reference numbers represent like parts throughout.

FIG. 3A is a sectional view of a three stage centrifugal compressor, according to an embodiment.

FIG. 3B is a sectional view of impellers and shaft of FIG. 3A, according to an embodiment.

FIG. 3C is an enlarged view of an area 3C of FIG. 3B.

DETAILED DESCRIPTION

Figure 1:
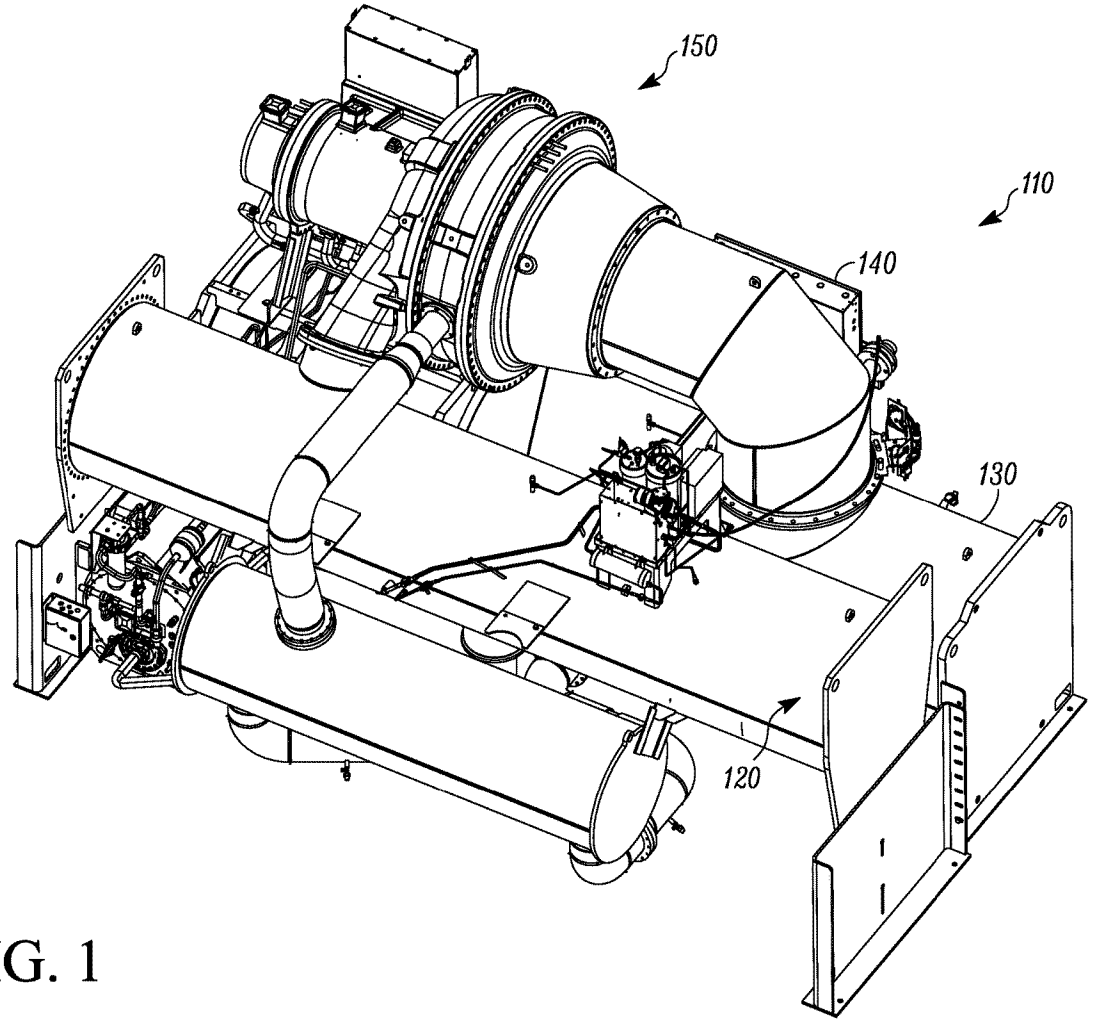
FIG. 1 illustrates a chiller with which embodiments disclosed in this specification can be practiced.

A centrifugal compressor can be used in various applications to compress a fluid, such as for example, a fluid in an HVAC unit and/or system (e.g., in a chiller) to compress a refrigerant gas. The centrifugal compressor can have one or more impellers arranged in series on a shaft, which is typically referred to as a single stage compressor or a multi-stage compressor respectively. The refrigerant gas is compressed by a centrifugal force of the impeller(s). In the multi-stage compressor, the fluid can be compressed by the plurality of impellers sequentially, increasing the pressure through each stage.

The impeller(s) are mounted to a common shaft that is driven by a motor. The impeller(s) can typically be fitted to the shaft by a clearance fit, a transitional fit, or a relatively light interference fit. During operation, thermal expansion/contraction of the impeller(s) and the shaft can lead to radial shift of the impeller(s), causing rotation imbalance and vibration. In some multi-stage compressors, even though each impeller may be fitted within a desired tolerance, a combination of the tolerance stack-up from the plurality of impellers in either the axial direction or the radial direction may still cause shaft deflection, which can lead to rotating imbalance that can increase compressor vibration.

Embodiments disclosed in this specification are directed to systems and methods to clamp an impeller on a shaft in a centrifugal compressor. The embodiments as disclosed are particularly suitable for a multi-stage impeller. The embodiments as disclosed may include independently clamping and supporting individual impellers on the shaft, which may reduce the tolerance stack-up effect that may be caused by a plurality of impellers.

Generally, the embodiments disclosed in this specification may include providing a relatively stiff support to a front side of the impeller, which can help reduce, for example, deflection to a shaft caused by the impeller. The embodiments may further include providing a relatively flexible support to a backside of the impeller, which can help compensate for, e.g., thermal expansion/contraction of the impeller and can reduce deflection to the shaft on which the impeller is mounted.

It is to be understood that the terms used herein are for describing the figures and embodiments and should not be regarded as limiting in scope.

A front side of an impeller generally refers to a side of the impeller receiving a fluid in operation (e.g., an outboard side of a compressor).

A backside of an impeller generally refers to a side of the impeller that is opposite to the front side (e.g., an inboard side of a compressor).

A relatively stiff support is relatively less pliable than a relatively flexible support. That is, the relatively flexible support is pliable. In some embodiments, the relatively stiff support can be alternatively referred to as a non-compliant member and the relatively flexible support can be alternatively referred to as a compliant member.

FIG. 1 illustrates a two stage centrifugal compressor 150, with which the embodiments disclosed in this specification can be practiced. It is to be understood that these embodiments may be used with a single stage centrifugal compressor, a three-stage centrifugal compressor, or other suitable multi-stage centrifugal compressor. The disclosed embodiments may also be suitable for other types of compressors that may produce an axial thrust during operation, such as for example a turbo compressor.

The centrifugal compressor 150 is illustrated to work in a chiller 110, with the understanding that a centrifugal compressor may also be used in other systems or applications.

The chiller 110 typically includes a condenser 120 and an evaporator 130 to form a refrigeration circuit together with the compressor 100. The chiller 110 may also include a control system 140 to control the operation of the chiller 110.

Figure 2:
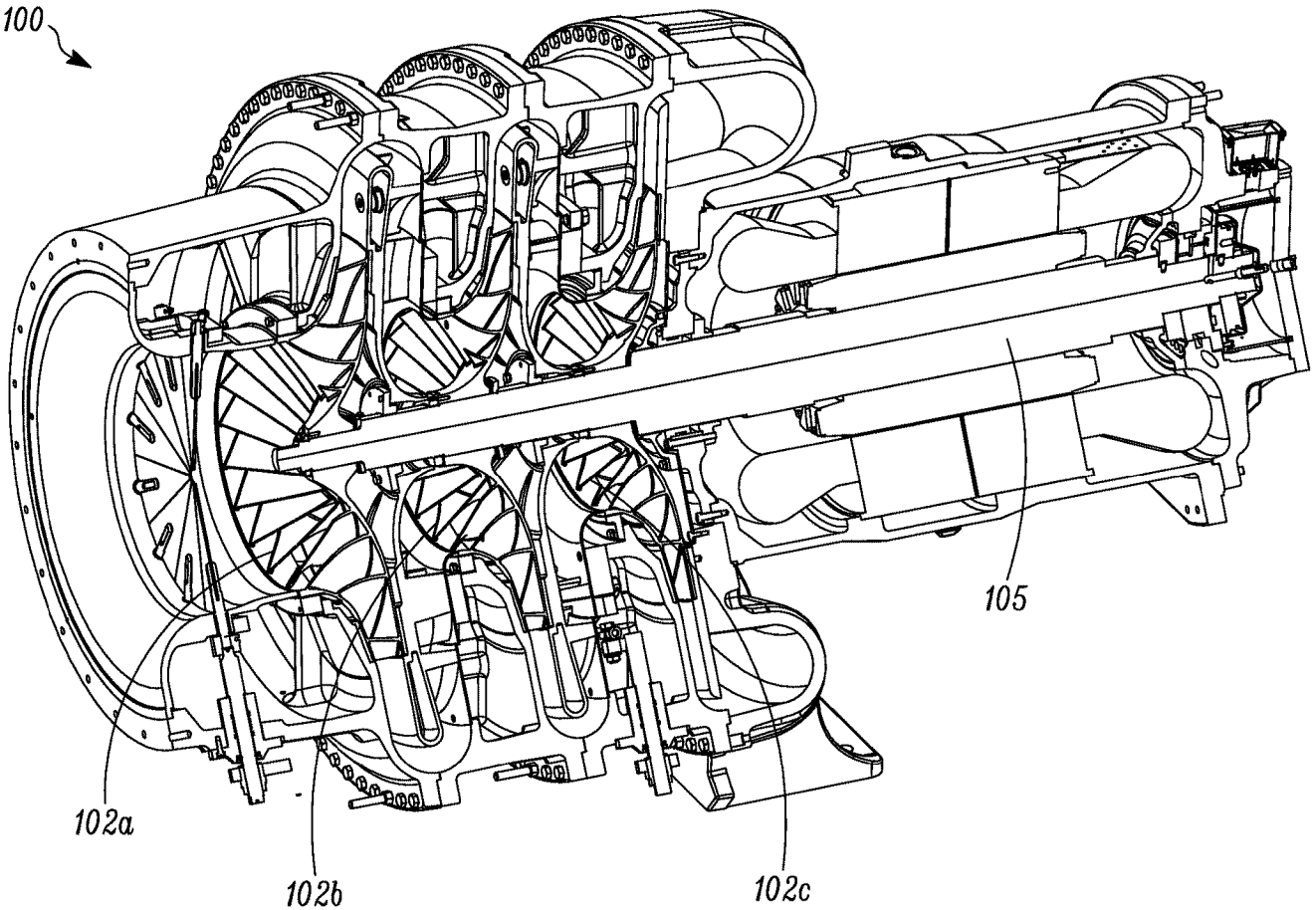
FIG. 2 illustrates a cutaway view of a compressor with which embodiments as disclosed in this specification can be practiced.

FIG. 2 illustrates a cutaway view of a compressor 100 with which embodiments as disclosed in this specification can be practiced. It will be appreciated that the compressor 100 can be used in the chiller 110 of FIG. 1 in place of the compressor 150 (FIG. 1). In the illustrated embodiment, the compressor 100 includes three impellers 102*a*, 102*b*, and 102*c*. The impellers 102*a*, 102*b*, and 102*c* are mounted on a shaft 105 in series. In operation, a gaseous refrigerant can be compressed by the impellers 102*a*, 102*b*, and 102*c* sequentially, which can increase a temperature and pressure of the refrigerant during the process.

Figure 3A:
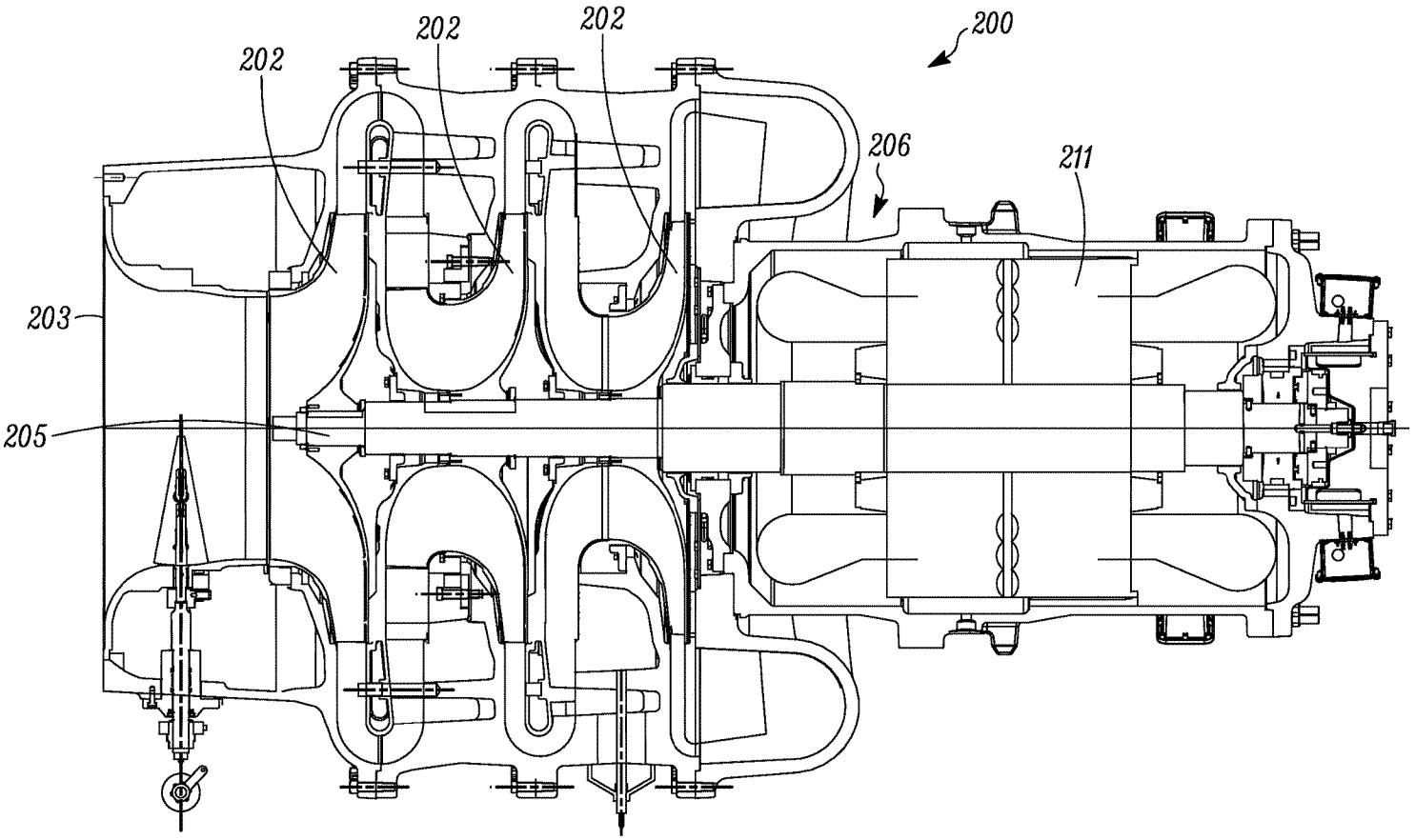
FIGS. 3A to 3C illustrate an embodiment of a clamping assembly to clamp an impeller to a shaft in a compressor.
Figure 3B:
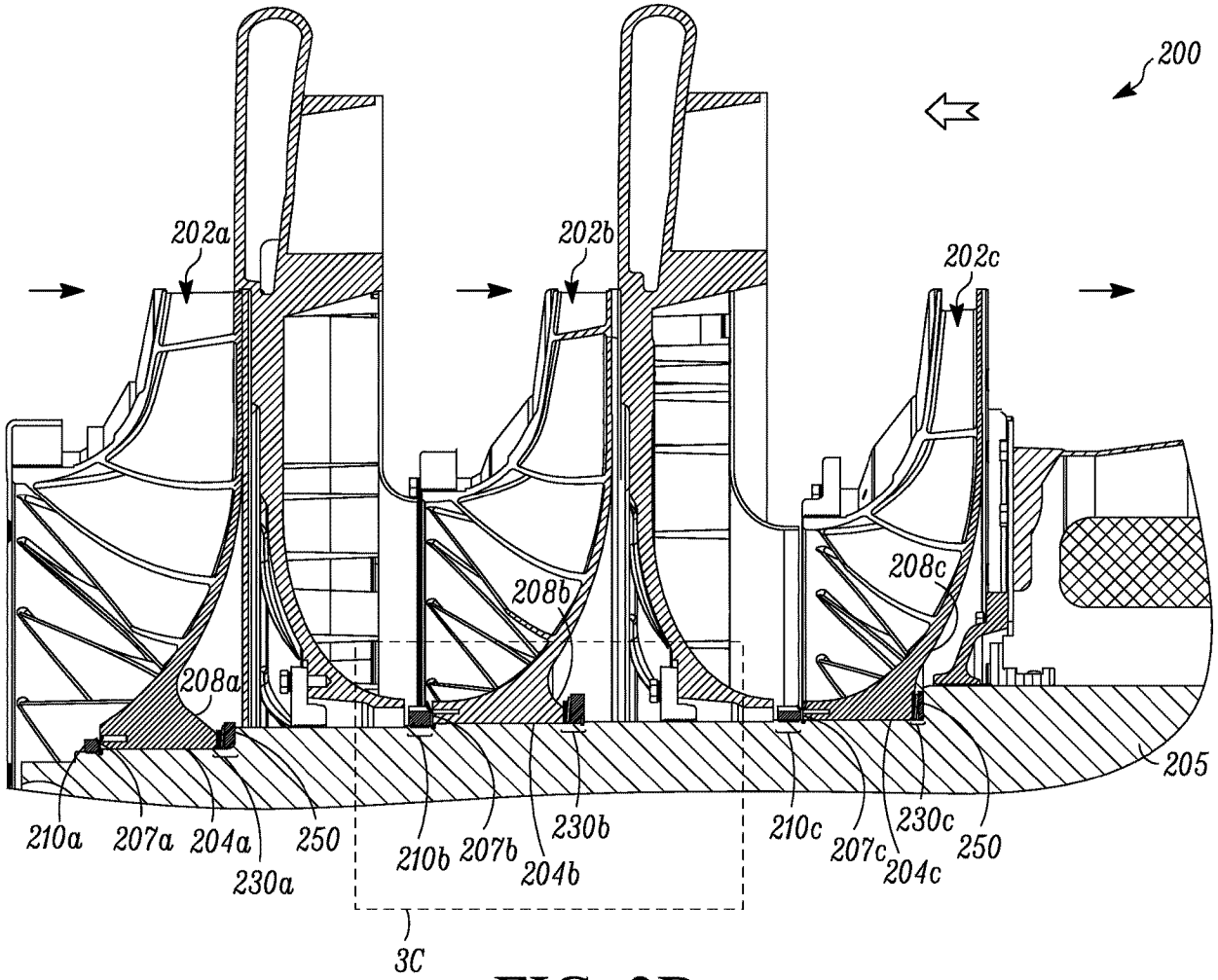

FIG. 3A illustrates a three stage compressor 200, with which an embodiment of a clamping assembly to mount one or more impellers 202 (e.g., the first impeller 202*a*, the second impeller 202*b*, and the third impeller 202*c* as illustrated in FIG. 3B) to a shaft 205 can be used. The shaft 205 and the impellers 202 can be rotated by a motor 211. The compressor 200 has an outboard side 203, from which a refrigerant gas can be directed toward the impellers 202 in operation. The refrigerant gas can be compressed by the impellers 202 and directed away from the impellers 202 at an inboard side 206. The inboard side 206 has a relatively higher pressure than the outboard side 203.

FIG. 3B illustrates a partial sectional view of the three-stage compressor 200 that includes a first impeller 202*a*, a second impeller 202*b*, and a third impeller 202*c* mounted on a shaft 205. Generally, each of the first, second, and third impellers 202*a*, 202*b*, and 202*c* (respectively) are clamped to shaft 205 by a clamping assembly that may include a relatively stiff support (e.g., the relatively stiff supports 210*a*, 210*b*, and 210*c*) to support a front side of the impellers 202*a*, 202*b*, and 202*c*. The clamping assembly may further include a relatively flexible support (e.g., the relatively flexibly supports 230*a*, 230*b*, and 230*c*) to support a backside of the impellers 202*a*, 202*b*, and 202*c*, the details of which are described herein.

The impellers 202*a*, 202*b*, and 202*c* can be mounted on the shaft 205 at their respective openings 204*a*, 204*b*, and 204*c*. The fitting of the impellers 202*a*, 202*b*, and 202*c* and the shaft 205 can be, for example, a press-fit. In some embodiments, the fitting of the impellers 202*a*, 202*b*, and 202*c* to the shaft can be, for example, a clearance fit, a transitional fit, a relatively light interference fit, or the like. The fitting may be relatively prone to a radial shift due to thermal expansion/contraction in operation.

In operation, a refrigerant gas can be introduced to the compressor 200 from the outboard side 203. The gas can be compressed by the first impeller 202*a*, the second impeller 202*b*, and the third impeller 202*c* sequentially, increasing a pressure of the gas (see left to right directional arrows, with respect to the page, in FIG. 3B). An axial thrust, which is in a direction from the inboard side 206 (see, e.g., the block arrow in FIG. 3B) to the outboard side 203 can act on the impellers 202*a*, 202*b*, and 202*c*. The axial thrust can lead to, for example, deflection, deformation, and/or radial shift of the impellers 202*a*, 202*b*, and 202*c*, as well as deflection of the shaft 205. To help reduce, e.g., the deflection, deformation, and/or radial shift in operation, relatively stiff supports 210*a*, 210*b*, and 210*c* can be provided to support the impellers 202*a*, 202*b*, and 202*c* in a direction that is generally opposite to the axial thrust.

Each of the impellers 202*a*, 202*b*, and 202*c* can be independently supported by the relatively stiff supports 210*a*, 210*b*, and 210*c* respectively. Referring to FIG. 3B, the relatively stiff supports 210*a*, 210*b*, and 210*c* can be used to provide a support to the impellers 202*a*, 202*b*, and 202*c* respectively in a direction that is generally opposite to the direction of the axial thrust when the impellers 202*a*, 202*b*, and 202*c* are under the axial thrust in operation. A front side 207*a*, 207*b*, and 207*c* of the impellers 202*a*, 202*b*, and 202*c* respectively can engage the relatively stiff supports 210*a*, 210*b*, and 210*c* respectively in operation. The support provided by the relatively stiff supports 210*a*, 210*b*, and 210*c* can, in some embodiments, help relieve the deflection to the impellers 202*a*, 202*b*, and 202*c* caused by the thrust.

The thrust load on each of the impellers 202*a*, 202*b*, and 202*c* is independently supported by the relatively stiff supports 210*a*, 210*b*, and 210*c* respectively. Comparing to the impellers 202*a*, 202*b*, and 202*c*, the relatively stiff supports 211*a*, 210*b*, and 210*c* has a relatively shorter moment arm with respect to the shaft 205. Sharing the load by the relatively stiff supports 210*a*, 210*b*, and 210*c* can therefore help reduce a risk of shaft deflection. Sharing the load by the relatively stiff supports 210*a*, 210*b*, and 210*c* can also help reduce the tolerance stack-up effect on the shaft 205 from the impellers 202*a*, 202*b*, and 202*c*. In some embodiments, the relatively stiff supports 210*a*, 210*b*, and 210*c* can reduce about ⅔ of the load from the shaft 205. In some embodiments, the relatively stiff supports 210*a*, 210*b*, and 210*c* may be configured to support about 10,000 pounds of impeller load in combination.

In a traditional design, a support may generally be installed against a first stage impeller. In some situations, when a refrigerant with a relatively high density is used, as much as 10,000 pounds of clamping load may be needed from the support to maintain impeller stability. Embodiments described in this specification can clamp individual impellers independently, splitting the clamp load between the individual impellers. This can help reduce the clamp load at each impeller and transfer, for example, as much as half the load (in a two-stage compressor design) or ⅔ of the load (in a three-stage compressor design) away from an end of the shaft. The clamp loads therefore act against a relatively shorter moment arm, reducing a risk of shaft deflection.

It is to be noted that the embodiments as disclosed in this specification may allow the impellers 202*a*, 202*b*, and/or 202*c* to be mounted on the shaft with a relatively tighter interference fit than in a traditional compressor.

Figure 3C:
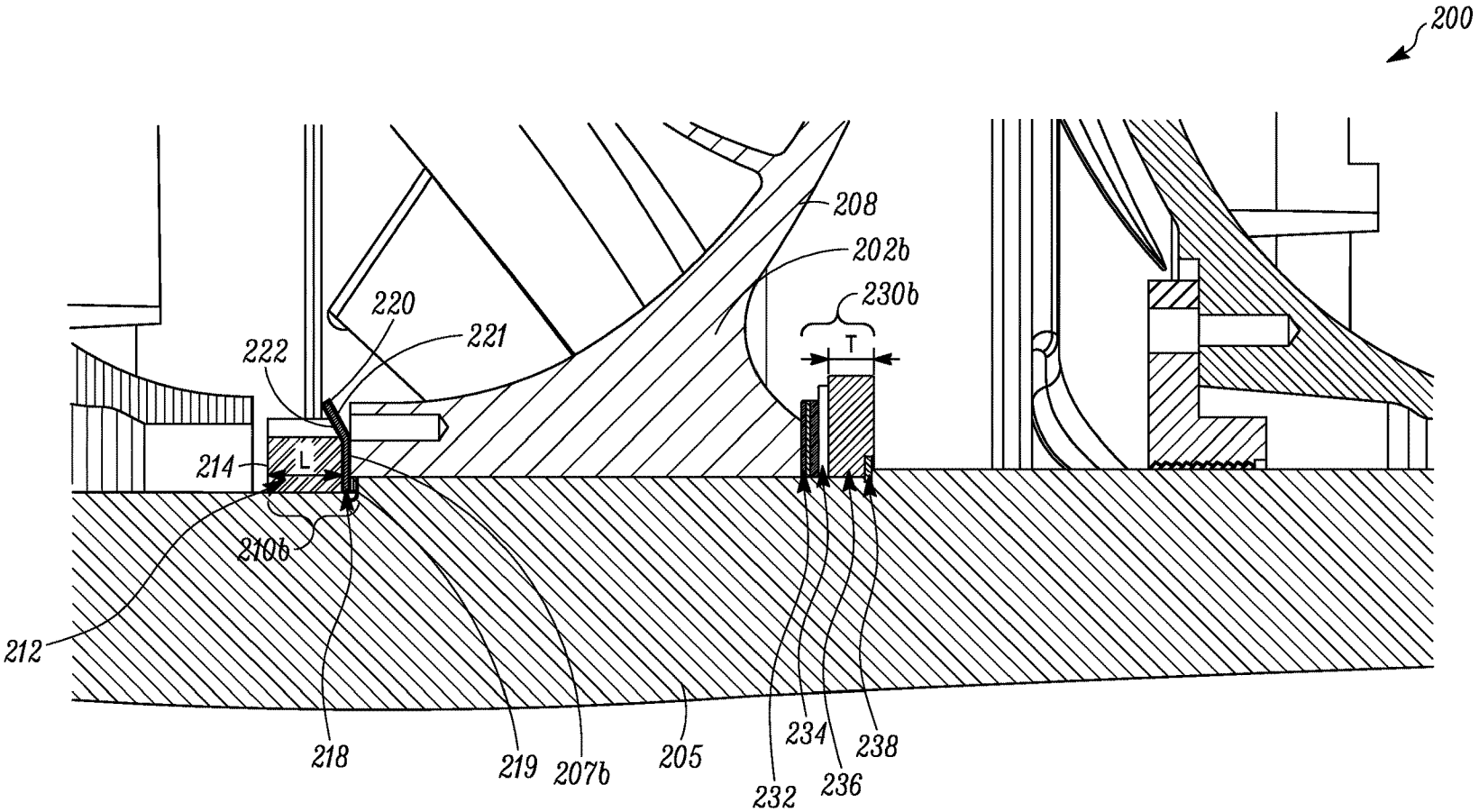

Referring to FIG. 3C, in the illustrated embodiment, the second relatively stiff support 210*b* may include a locknut 212 that is threaded to the shaft 205 by threads 214. The threads 214 may be accurate and true so that the position of the locknut 212 can be precisely located and/or adjusted. In the illustrated embodiment, a supporting surface of the locknut 212 and the front side 207*b* of the impeller 202*b* can be separated by a washer 220. In some embodiments, as illustrated in FIG. 3C, the washer 220 can include an inner tab 218 that fits into a shaft keyway or slot 219, and an outer tab 221 that is bent into a slot 222 on the outer diameter of the locknut 212.

Referring back to FIG. 3B, the other relatively stiff supports 210*a* and 210*c* may be similarly configured as the second relatively stiff support 210*b* as illustrated in FIG. 3C.

Referring to FIGS. 3B and 3C together, the locknut 212 has a length L in the axial direction of the shaft 205. In some embodiments, the length L of locknuts 212 of the relatively stiff supports 210*a*, 210*b*, and 210*c* may get larger in succession to adapt for larger loads during operation on the impellers 202*a*, 202*b*, and 202*c* from the outboard side 203 toward the inboard side 206.

Referring to FIG. 3B, the impellers 202*a*, 202*b*, and 202*c* can also be supported by relatively flexible supports 230*a*, 230*b*, and 230*c* on a backside 208*a*, 208*b*, and 208*c* of the impellers 202*a*, 202*b*, and 202*c* respectively.

The relatively flexible supports 230*a*, 230*b*, and 230*c* are configured to provide a relatively more flexible support to the backside 208*a*, 208*b*, and 208*c* in the axial direction compared to the relatively stiff supports 210*a*, 210*b*, and 210*c*. The relatively flexible support 230*a*, 230*b*, and 230*c* can, for example, compensate for a thermal expansion/contraction of the impellers 202*a*, 202*b*, and 202*c* in operation. That is, the relatively flexible supports 230*a*, 230*b*, and 230*c* can contract and/or expand in the axial direction to compensate the thermal expansion/contraction of the impellers 202*a*, 202*b*, and 202*c* in operation. The relatively flexible support 230*a*, 230*b*, and 230*c* can provide a support to the backsides 208*a*, 208*b*, and 208*c* of the impellers 202*a*, 202*b*, and 202*c* respectively so as to reduce the axial load by the impellers 202*a*, 202*b*, and 202*c* acting on the relatively stiff supports 210*a*, 210*b*, and 210*c*.

Referring to FIG. 3C, more details for the relatively flexible support 230*b* for the impeller 202*b* are illustrated. It is to be understood that the relatively flexible supports 230*a* and 230*c* may be similarly configured. In the illustrated embodiment, the relatively flexible support 230*b* may include one or more shim members 232, a spring member 234 (e.g., a conical washer such as, but not limited to, a Belleville washer, or the like), a spacing member 236 and a retaining member 238.

When the impeller 202*b* is installed on the shaft 205, the impeller 202*b* may be adjusted by axially positioning/adjusting the relatively stiff support 210*b* on the shaft 205.

In some embodiments, the spring member 234 can be pre-loaded to help maintain the stability of the impeller 202*b* during operation. In some embodiments, the pre-load is about 700 pounds. A load/compression curve of the spring member 234 may be configured so that the load of the spring member 234 does not change significantly during operation. This may allow the relatively stiff support 210*b* to have a relatively large range of movement to help adjust the axial location of the impeller. In some embodiments, compared to a traditional design that includes a spring member installed on a front side of an impeller, the pre-load of the spring member according to embodiments herein can be about ⅓ of the pre-load in the traditional design.

The shim member 232 is positioned between the backside 208*b* of the impeller 202*b* and the spring member 234. The shim member 232 (e.g., a thickness of the shim member 232) can be configured and/or varied during an impeller installation process to help adjust the impeller 202*b*, taking into consideration tolerance stack-ups and the compression of the spring member 234 during operation.

The spacing member 236 has a thickness T. The thickness T can be sized so that the spring member 234 may not cause significant deflection to the spacing member 236. The spacing member 236 can also engage the retaining member 238 (e.g., by receiving the retaining member 238 in a slot) so that the spacing member 236 can be retained on the shaft 205 at least in the axial direction. The spacing member 236 may also be configured to radially constrain the retaining member 238, so as to, for example, avoid centrifugal expansion of the retaining member 238 during operation.

The relatively flexible supports 230*a*, 230*b*, and 230*c* may be supported in the axial direction. Referring to FIG. 3B, the shaft 205 of the illustrated embodiment can have one or more shoulders 250. The shoulders 250 may be used to support the relatively flexible supports (e.g., the relatively flexible supports 230*a*, 230*c*) directly in the axial direction. In some embodiments, the shaft 205 may not have a shoulder-like structure available to provide the axial support to the relatively flexible support, such as in the case of the relatively flexible support 230*b*. A retaining member similar to the retaining member 238 in FIG. 3C may be used to retain the spacing member so as to provide an axial support. It is to be appreciated that the spacing member 234 can also be retained on the shaft 250 by other suitable retaining methods or devices.

The embodiments of a clamping assembly to clamp an impeller in a compressor as disclosed herein generally include two types of supports: a relatively stiff support (e.g., the relatively stiff supports 210*a*, 210*b*, and 210*c* in FIGS. 3B and 3C) and a relatively flexible support (e.g., the relatively flexible supports 230*a*, 230*b*, and 230*c* in FIGS. 3B and 3C). In operation, the impeller may be under an axial thrust load in an axial direction from an inboard side to an outboard side. The impeller may be supported by the relatively stiff support on the inboard side to reduce, for example, deflection/deformation caused by the axial thrust load. The impeller may be supported by the relatively flexible support on the outboard side. In a multi-stage compressor with more than one impeller, each impeller may be independently supported by the two types of supports.

In operation, the load (e.g. a thrust load) on each impeller can be relieved by the relatively stiff supports, reducing deflection of each impeller and the tolerance stack-up effect. The relatively flexibly support can help compensate for, e.g. thermal expansions and/or help reduce deflection of the shaft.

It is to be appreciated that an impeller can be mounted on a shaft via an interference fit. The interference fit can be a balance, for example, between what is suitably desired and/or necessary to maintain an interference fit through as much of the operation range as possible and what is suitably desired and/or necessary to avoid excessive impeller stress during shipping or storage in relatively cold ambient temperatures. In some HVAC systems with a three-stage compressor, the first stage impeller decrease in temperature, while the second and third stage impellers increase in temperature during operation. The interference fit may be about 0 to about 0.002" for the first impeller, and about 0.001" to about 0.003" for the second and third stage impellers. By using the embodiments as described herein, the interference fit may be tighter than in a traditional compressor.

It is to be appreciated that embodiments as described herein may be applied to impellers which are mounted on a shaft via a fit other than an interference fit, such as any press-fit including, but not limited to, a clearance fit, or the like.

It is to be appreciated that the embodiments as disclosed may also be applicable in other devices that require mounting an impeller to a shaft, particularly when the impeller may be under a pressure in operation. For example, the embodiments as disclosed herein may be applicable to a pump, a turbo machine, or the like.

Aspects:

Any one of aspects 1-5 can be combined with any one of aspects 6-19. Any one of aspects 6-12 can be combined with any one of aspects 13-19.

Aspect 1. A system to clamp an impeller to a shaft in a compressor, comprising:

a relatively stiff support to support a front side of the impeller; and a relatively flexible support to support a backside of the impeller, wherein the front side of the impeller receives a fluid in operation, and the backside is opposite to the front side with the respect to the impeller; and the relatively stiff support is positioned to relieve at least a portion of thrust load on the impeller during operation.

Aspect 2. The system of aspect 1, wherein the relatively stiff support includes a locknut.

Aspect 3. The system of aspect 2, wherein the relatively stiff support further includes a washer between the locknut and the front side of the impeller.

Aspect 4. The system of any one of aspects 1-3, wherein the relatively flexible support includes a shim member, a spring member, and a spacing member; and the shim member is configured to be in contact with the backside of the impeller.

Aspect 5. The system of aspect 4, wherein the spring member is a conical washer.

Aspect 6. A compressor, comprising:

an impeller including a front side and a backside;

a relatively stiff support to support the front side of the impeller; and a relatively flexible support to support the backside of the impeller, wherein the front side of the impeller receives a fluid in operation, and the backside is opposite to the front side with the respect to the impeller; and the relatively stiff support is positioned to relieve at least a portion of thrust load on the impeller during operation.

Aspect 7. The compressor of aspect 6, wherein the relatively stiff support includes a locknut.

Aspect 8. The compressor of aspect 7, wherein the relatively stiff support further includes a washer between the locknut and the front side of the impeller.

Aspect 9. The compressor of any one of aspects 6-8, wherein the relatively flexible support includes a shim member, a spring member, and a spacing member; and the shim member is configured to be in contact with the backside of the impeller.

Aspect 10. The compressor of aspect 9, wherein the spring member is a conical washer.

Aspect 11. The compressor of any one of aspects 6-10, wherein the compressor is a multi-stage compressor.

Aspect 12. The compressor of any one of aspects 6-11, wherein the compressor is a refrigerant compressor in a heating, ventilation, and air conditioning system.

Aspect 13. A method of clamping an impeller in a compressor, comprising:

providing a relatively stiff support to a front side of the impeller; and providing a relatively flexible support to a backside of the impeller.

Aspect 14. The method of aspect 13, wherein the wherein the relatively stiff support includes a locknut.

Aspect 15. The method of aspect 14, wherein the relatively stiff support further includes a washer between the locknut and the front side of the impeller.

Aspect 16. The method of any one of aspects 13-15, wherein the relatively flexible support includes a shim member, a spring member and a spacing member; and the shim member is configured to be in contact with the backside of the impeller.

Aspect 17. The method of aspect 16, wherein the spring member is a conical washer.

Aspect 18. The method of any one of aspects 13-17, wherein the compressor is a multi-stage compressor.

Aspect 19. The method of any one of aspects 13-18, wherein the compressor is a refrigerant compressor in a HVAC system.

The terminology used in this specification is intended to describe particular embodiments and is not intended to be limiting. The terms “a,” “an,” and “the” include the plural forms as well, unless clearly indicated otherwise. The terms “comprises” and/or “comprising,” when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure indicated by the claims that follow.

What is claimed is:

1. A system to clamp an impeller to a shaft in a refrigerant compressor in a heating, ventilation, and air conditioning (HVAC) system, the impeller being fitted onto the shaft, comprising:

a relatively stiff support to support a front side of the impeller, the relatively stiff support configured to be fitted onto an outside surface of the shaft, the relatively stiff support including a locknut and a washer, the washer being disposed between the locknut and the front side of the impeller, the washer including an inner tab and an outer tab, the inner tab fits into a slot on the shaft and the outer tab is bent into a slot on the locknut; and a relatively flexible support to support a backside of the impeller, the relatively flexible support configured to be fitted onto the shaft and abut the backside of the impeller, wherein the front side of the impeller receives a flow of refrigerant gas in operation, and the backside of the impeller is opposite to the front side of the impeller, and the relatively stiff support is positioned to relieve at least a portion of a thrust load on the impeller during operation, the thrust load being in a direction from the backside of the impeller to the front side of the impeller.

2. The system of claim 1, wherein the relatively flexible support includes a shim member, a spring member, and a spacing member; and the shim member is configured to be in contact with the backside of the impeller.

3. The system of claim 2, wherein the spring member is a conical washer.

4. A refrigerant compressor in a heating, ventilation, and air conditioning (HVAC) system, comprising:

a shaft;

an impeller including a front side and a backside, the impeller being fitted onto the shaft, the front side of the impeller receiving a flow of refrigerant gas in operation, and the backside of the impeller being opposite to the front side of the impeller, a thrust load being in a direction from the backside of the impeller to the front side of the impeller;

a relatively stiff support fitted onto an outside surface of the shaft on the front side of the impeller to support the front side of the impeller, the relatively stiff support positioned to relieve at least a portion of the thrust load, the relatively stiff support including a locknut and a washer, the washer being disposed between the locknut and the front side of the impeller, the washer including an inner tab and an outer tab, the inner tab fits into a slot on the shaft and the outer tab is bent into a slot on the locknut; and a relatively flexible support fitted onto the shaft and abutting the backside of the impeller to support the backside of the impeller.

5. The refrigerant compressor of claim 4, wherein the relatively flexible support includes a shim member, a spring member, and a spacing member; and the shim member is configured to be in contact with the backside of the impeller.

6. The refrigerant compressor of claim 5, wherein the spring member is a conical washer.

7. The refrigerant compressor of claim 4, wherein the compressor is a multi-stage compressor and includes a plurality of impellers fitted onto the shaft, a plurality of relatively stiff supports, and a plurality of relatively flexible supports, two or more of the plurality of impellers each including one of the plurality of relatively stiff supports and one of the plurality of relatively flexible supports.

8. The compressor of claim 4, wherein the impeller is fitted onto the shaft by one of a clearance fit, a transitional fit, and an interference fit.

9. A method of clamping an impeller to a shaft in a multi-stage compressor in a heating, ventilation, and air conditioning (HVAC) system, the compressor including a plurality of impellers arranged axially to be clamped to the shaft, the plurality of impellers being fitted onto the shaft, comprising:

supporting, with a plurality of relatively stiff supports fitted onto an outside surface of the shaft, a front side of two or more of the plurality of impellers, the front side of the two or more impellers receiving a flow of refrigerant gas in operation, two or more of the plurality of impellers being supported by one of the plurality of relatively stiff supports, the plurality of relatively stiff supports including a locknut and a washer, the washer being disposed between the locknut and the front side of the two or more of the plurality of impellers, the washer including an inner tab and an outer tab, the inner tab fits into a slot on the shaft and the outer tab is bent into a slot on the locknut; and supporting, with a plurality of relatively flexible supports fitted onto the shaft, a backside of the two or more impellers, the plurality of relatively flexible supports abutting the backside of the two or more impellers, the backside of the two or more impellers being opposite the front side of the impeller, two or more of the plurality of impellers being supported by one of the plurality of relatively flexible supports, wherein the relatively stiff supports are positioned to relieve at least a portion of the thrust load on the two or more impellers during operation of the compressor, the thrust load being in a direction from the backside of the two or more impellers to the front side of the two or more impellers.

10. The method of claim 9, wherein the plurality of relatively flexible supports each include a shim member, a spring member, and a spacing member, and the shim member is configured to be in contact with the backsides of the two or more of the plurality of impellers.

11. The method of claim 10, wherein the spring member is a conical washer.

12. The method of claim 9, further comprising aligning each of the plurality of relatively stiff supports using an inner tab on the washer, the aligning including locating the inner tab of the washer with a keyway on the shaft.

* * * * *